US006313421B1

(12) United States Patent
Abrahamsen

(10) Patent No.: US 6,313,421 B1
(45) Date of Patent: Nov. 6, 2001

(54) CONTACT AND CONTROL MODULE

(75) Inventor: John Abrahamsen, Nordborg (DK)

(73) Assignee: Linak A/S, Nordborg (DK)

( * ) Notice: Subject to any disclaimer, the term of this patent is extended or adjusted under 35 U.S.C. 154(b) by 0 days.

(21) Appl. No.: 09/341,274

(22) PCT Filed: Jan. 9, 1998

(86) PCT No.: PCT/DK98/00012

§ 371 Date: Jul. 7, 1999

§ 102(e) Date: Jul. 7, 1999

(87) PCT Pub. No.: WO98/31030

PCT Pub. Date: Jul. 16, 1998

(30) Foreign Application Priority Data

Jan. 9, 1997 (DK) ..... 0020/97
Jan. 9, 1997 (DK) ..... 0021/97

(51) Int. Cl.[7] ..... H01H 3/14

(52) U.S. Cl. ..... 200/332.1; 200/86.5; 200/331; 200/17 R

(58) Field of Search ..... 200/16 R–16 D, 200/17 R, 18, 5 R, 86.5, 511, 520, 533–536, 573, 574, 329–331, 337, 338, 341, 332.1

(56) References Cited

U.S. PATENT DOCUMENTS 3,354,276 11/1967 Shoffner ..... 200/86.5
4,455,466 * 6/1984 Wilson ..... 200/86.5
4,954,668 * 9/1990 Sako ..... 200/314
5,132,498 * 7/1992 Lee ..... 200/523
5,146,054 9/1992 Etters ..... 200/85 A
5,712,460 * 1/1998 Carr et al. ..... 200/86.5
5,804,786 * 9/1998 Braaten ..... 200/86.5
6,051,799 * 4/2000 Fuhrmann ..... 200/331
6,064,015 * 5/2000 Braaten ..... 200/86.5

FOREIGN PATENT DOCUMENTS 3837653 5/1989 (DE) ..... H01H/3/12
3819716 12/1989 (DE) ..... H01H/9/02
0365507 4/1990 (EP) ..... H01H/3/14

* cited by examiner

*Primary Examiner*—Michael Friedhofer
(74) *Attorney, Agent, or Firm*—Dykema Gossett PLLC

(57) ABSTRACT

The invention relates to a modular electrical contact in which the electrical components are separated in a separate module, and in which the others of the modules of the contact are built without electrical components. An advantageous embodiment according to the invention comprises a mechanical motion transmission advantageous for the purpose, where one or more contacts (53) may be activated through pressure operation. The device comprises a guide rail (52) with an activating element (51) which comprises a pressure element (55) and an extension element (54) and arranged with fixing means with respect to the guide rail so that the pressure element is slidable therein for activation of one or more contacts (53) arranged at the end of the pressure element. This provides an extremely simple, sturdy and flat structure which is simple to manufacture and simple to mount. This operating device is particularly suitable for use in foot pedals.

13 Claims, 3 Drawing Sheets

CONTACT AND CONTROL MODULE

FIELD OF THE ART

Figure 1:
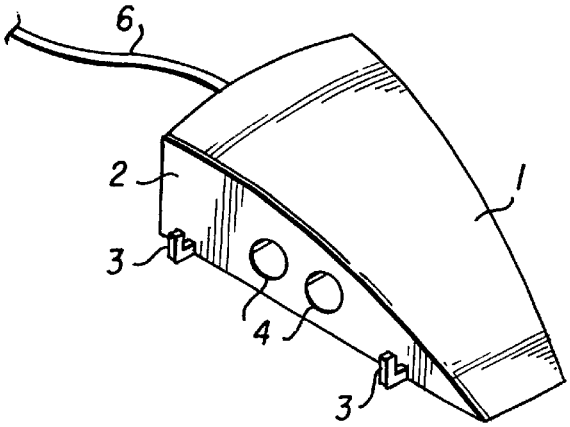

The invention relates to a contact module and more particularly for an electrical contact module that are resistive to environmental damage such as that caused by moist or dirty environments.

Known electrical operating contacts have the drawback in various apparatus connections that they are frequently relatively vulnerable to the environment in which they are used. This applies to locations where it right be desired to maintain a relatively high hygienic standard, as the cleaning necessary for the purpose may cause steam, water or high pressure to penetrate into the operating contacts, which leads to damage.

This especially applies to foot operated contacts, as foot operated contacts, in connection with moist cause or dirty environments, are naturally subjected to a strong mechanical action. This action may cause wear, which subsequently results in destruction of possible seals which were to keep water out from the more sensitive parts of the contact.

Examples of such uses might be kitchen cupboards, etc. for handicapped persons, lifting columns for tables, working tables, dentist's chairs and equipment, and other uses where it must be possible to maintain hygiene and safety with simple means.

Generally, the operation takes place with pressure-operated devices in which the pressure causes activation of an electrical contact or the like. Such devices may be constructed as operating panels in wall installations, foot pedals, control panels or the like, connected by a cable with the apparatus which is to be controlled.

Various requirements are made with respect to the structure of the device depending on how the operator is to perform the operation. As a result, it is frequently required that the operating device does not take up unduly much space and thereby interferes with the operator's other activities around the equipment, just as the operating device must be sturdy so that it does not lose its ability to function because of rough handling or because of wear after use for an extended period of time. Furthermore, requirements are also made of the operating device because of the design of the operating panel.

Various simple structures are known in this connection in which the pressure impact causes rotation or tilting of an adapter which is thereby contacted with a microswitch or other contact and activates it. These types of operating devices frequently contain a good deal of individual components which have to be assembled accurately. Such devices can moreover be inexpediently bulky in same cases.

The object of the invention is to provide a structurally simple contact unit which uses relatively simple components, and which reduces the requirement for official approval. Another object of the invention is to provide a device for operating contacts, such as electrical contacts, which overcomes the drawbacks of the known devices and which thus satisfies the constructional requirements better.

SUMMARY OF THE INVENTION

The contact module comprises a housing with electrical contacts which may be activated mechanically in at least one connecting part arranged on the housing, and the connecting part comprises one or more connecting elements. This provides a very compact contact module capable of being connected and activated by other units or modules via the connecting part.

An advantage of the invention is thus that the operating modules may be made purely mechanically, which gives an advantage in connection with cleaning as well as sturdiness.

Connecting elements mean various types of mechanical devices which are capable of engaging or being secured to a corresponding connecting element. A wide range of connecting techniques, such as hooks, screws, recesses or the like, may thus be used.

An advantage of the invention is to achieve flexibility. It is thus possible to use one specific contact module in several different applications by connecting various types of operating modules on the same contact module, if the connecting parts and the mechanical transmission between these are dimensioned suitably. A contact module according to the invention may thus be arranged in a simple manner to be connected with various types of operating modules having one, two, three or more operating contacts.

A further advantage of the invention is achieved with respect to the current procedures of approval, since the electrical components for the operation are isolated in one compact module.

A further advantage of the invention is that the compact structure of the electrical components in a module ensures that the electrical components may be sealed or encapsulated in a simple manner.

This results in the additional possibility of using less expensive electrical contacts.

This is an important factor when maintaining the necessary sturdiness to the cleaning which the complete structure must be capable of tolerating.

Isolation of the electrical components in one compact unit does not only make it possible to obtain a structure which may be designed without too many irregularities and thereby does not collect so much dirt and bacteria. It also provides the possibility of designing purely mechanical structures which per se are considerably more sturdy against cleaning by means of steam.

A further advantage of the invention is achieved with respect to service, as primarily isolated mechanical or electrical defects will occur, which means that a contact module or an operating module can be replaced and/or repaired separately if defects or wear occurs.

Communication between a contact module and an external unit may optionally be obtained by means of remote control technique.

The contact module has an external electrical connection which is connected electrically to the electrical contacts internally in the housing, thereby providing a practical embodiment of the invention as a cable connection is preferred in many cases, since these are relatively simple, reliable and economic.

The connecting part has a plurality of holes or depressions provided in the housing, each of the hole or depression being provided with an electrical contact which may be activated mechanically through the hole or depression.

The operating module comprises a housing with at least one corresponding connecting part with corresponding connecting elements. The operating module additionally comprises one or more operating contacts which transfer a force on the operating contacts to the connecting part via one or more mechanical connections. There is also at least one operating contact being mechanically connected with a connecting part so that an operating module of a simple mechanical structure is obtained. The individual operating modules may be made with various physical shapes, so that the user will have the possibility of building precisely the physical structure of the complete foot operation of standard operating modules and contact modules that might be expedient.

The mechanical connection comprises a mechanical rod extending completely or partly through the housing and terminating in the vicinity of a connecting part hole formed in the housing. The rod is connected with an operating contact activatable vertically on the rod allowing operating contacts or the operating contacts to be placed on the upper side of the housing of the operating module and allowing the connecting part to be formed by one or more of the side walls of the housing. This embodiment thus provides for an advantageous operation of the operating contacts, combined with the possibility of an advantageous connection via the connecting part with other operating modules or the contact module.

The perpendicular connection may be provided in numerous ways. The mechanical connection may be made with an upwardly directed through hole in which a rod having an inclined engagement face following the movement of the operating contact may cause movement of the mechanical connection.

Further, the mechanical rod terminating in the vicinity of a connecting part hole formed in the housing comprises a resiliently compressible part and a consequent return movement on the mechanical rod. A certain form of operating comfort is achieved, it being also noted that overloading of the operating contact connected with the mechanical rod does not necessarily propagate to the other mechanical parts of the module.

The operating device is formed with a guide rail in which an activating element having a pressure element and an extension element, is arranged with fixing means to fix the activating element with respect to the guide rail. The pressure element is slidable therein to activate one or more contacts, arranged at the end of the pressure element, because of a pressure action on the extension element against the guide rail. This provides an operating device in which the pressure action is transformed into a transverse translatory or linear movement, whereby a device according to the invention will have an extremely simple, sturdy and flat structure which is particularly suitable in connection with the construction of foot pedals.

In a preferred embodiment of the operating device, the extension element comprises a spring device, such as a leaf spring, whose ends will be displaced from each other along the guide rail by the pressure action against the guide rail. A pressure action in a direction different from, preferably transversely to the guide rail, can hereby be transformed in a simple manner into a movement in the longitudinal direction of the guide rail. This means that the activating element may be formed in one piece, such as in a plastics moulding. This structure of an operating device according to the invention involves the particular advantage of being easy to manufacture and mount, as the necessary functions for the operation of the operating device are provided in the same subcomponent.

The extension element is positioned between the fixing means and the pressure element. It is hereby ensured that the whole length of the displacement of the ends from each other is converted into a translatory travel of the pressure element.

Furthermore, the pressure element may be provided with an elastically resilient deformation zone and preferably moreover with an activating pin at the end facing the contact, the activating pin being provided with a spring collar. This deformation zone will be capable of absorbing the excess travel of the pressure element with respect to the necessary travel to activate the contact which is present opposite the end of the activating element. When the outer end of the deformation zone is provided with an activating pin with a counter-resilient collar, a precise activation of the contact is ensured, just as the counter resilience can supplement the extension element when the activating element is to be returned to the position of rest in which the extension element is not subjected to any pressure. It is realized in a variant of the invention that the activating element may comprise two or more pressure elements and associated extension elements which are connected with a common fixing means. Two or more contacts may hereby be operated individually using the same activating element, which is moulded and mounted as one member.

It is possible for the operating unit to comprise one or more operating units according to the invention and one or more operating modules according to the invention.

LIST OF FIGURES

Figure 2:
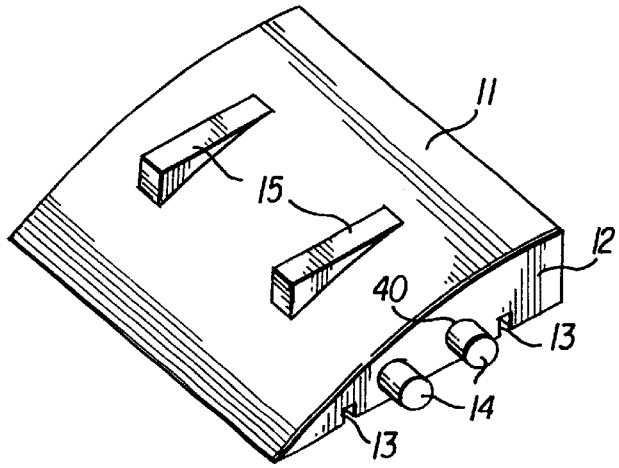
Figure 3:
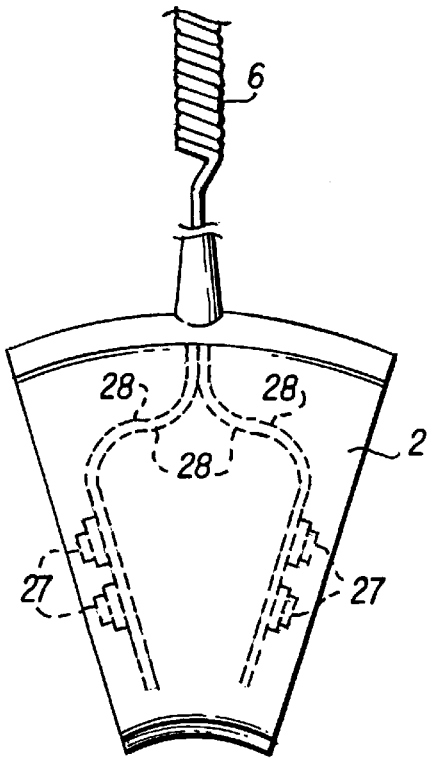
Figure 4:
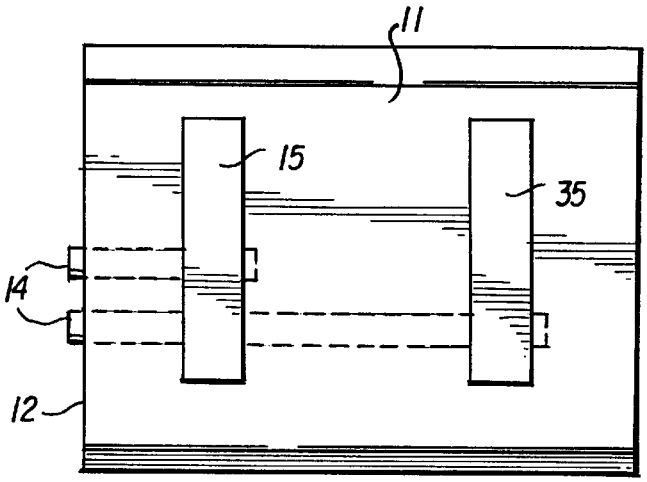
Figure 5:
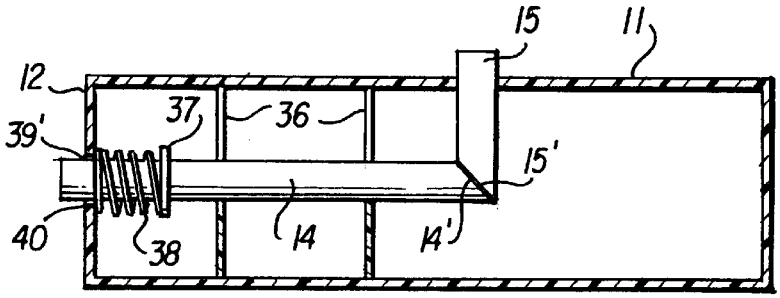
Figure 6:
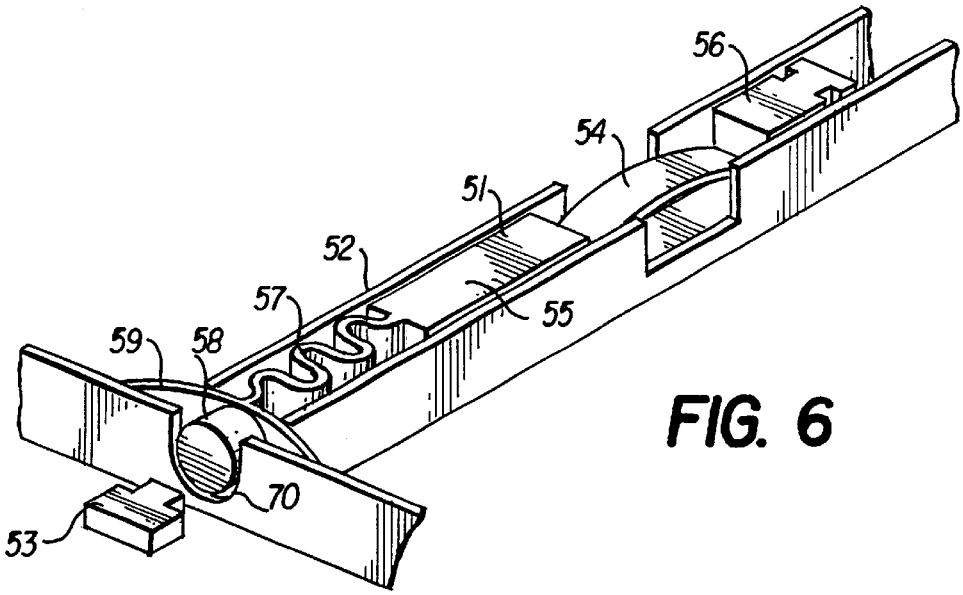
Figure 7:
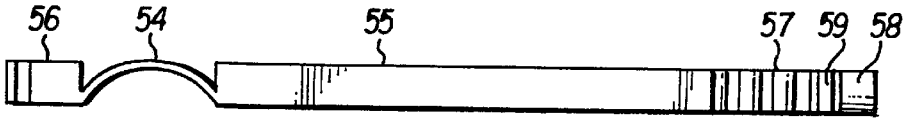
Figure 8:
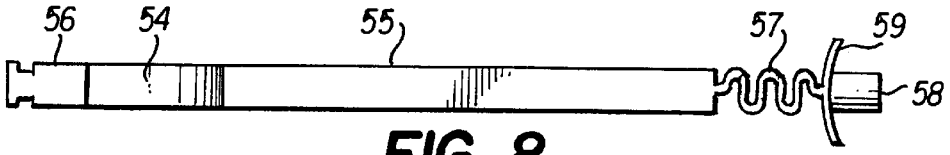
Figure 9:
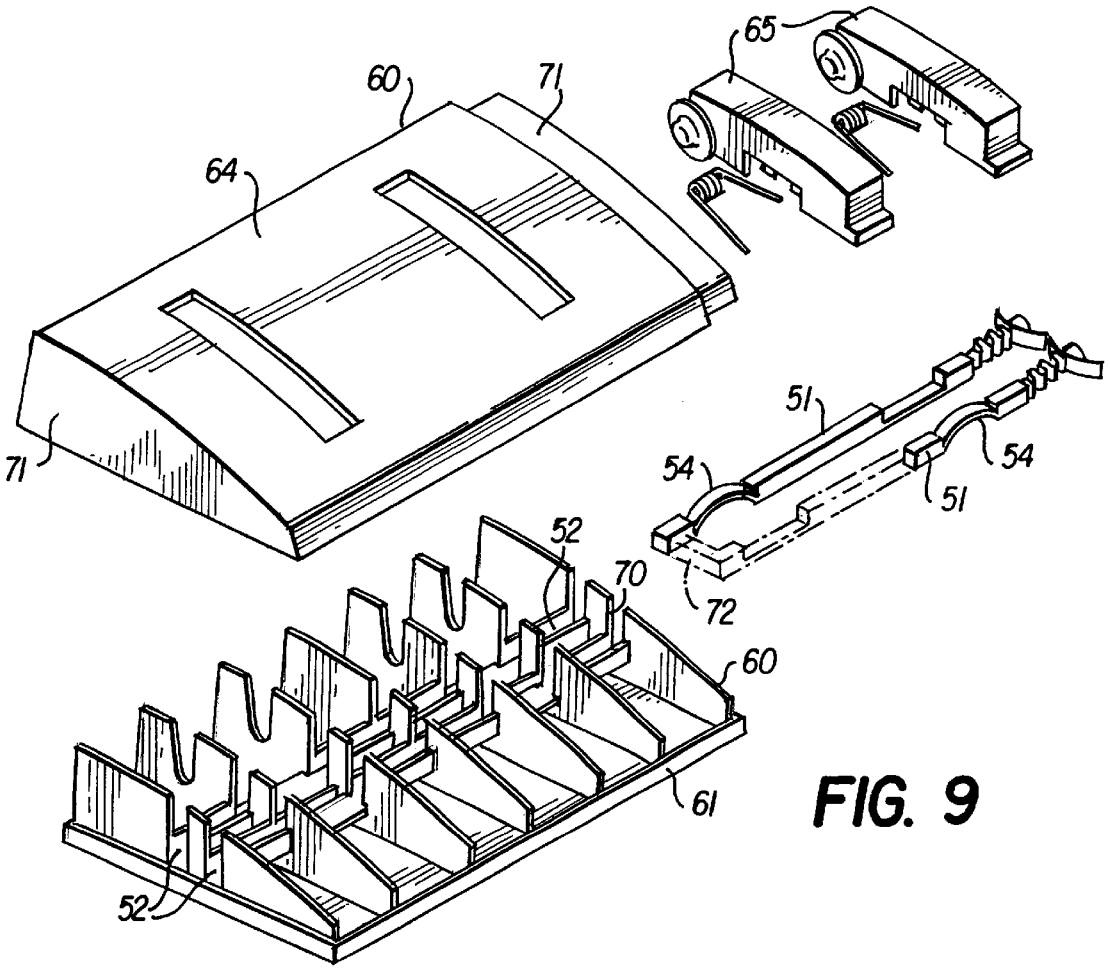

The invention will be described more fully below with reference to the figures, in which FIG. 1 shows a contact module according to the invention, FIG. 2 shows an operating module according to the invention, FIG. 3 shows a top view of a contact module according to the invention, FIG. 4 shows a top view of an operating module according to the invention, FIG. 5 shows a section of a perpendicular activating element for motion transmission in an operating module according to the invention, FIG. 6 shows a preferred perpendicular activating element for motion transmission in an operating module according to the invention, FIG. 7 shows a lateral view of the activating element shown in FIG. 6, FIG. 8 shows a top view of the activating element shown in FIG. 6, and FIG. 9 shows an exploded view of an operating panel for a foot pedal with an operating device according to the invention.

FIG. 1 shows a contact module according to the invention. The contact module comprises a housing 1 which is formed with a connecting part in the form of a substantially laterally directed face 2. The face 2 is provided with two holes 4 through which mechanical connection with electrical contacts (not shown) arranged in the housing 1 may be obtained. The face 2, i.e. the connecting part, is additionally provided with connecting elements in the form of hooks 3.

The contact element also has an electrical connection 6 which may be connected with a control unit, the electrical connection passing electrical signals by means of a wiring (not shown) to the control unit in dependence on the action exerted on the electrical contacts.

FIG. 2 shows an operating module according to the invention. The operating module comprises a housing 11 which is formed with a connecting part in the form of a substantially laterally directed face 12. The face 12 is provided with two through rods 14, which are mechanically connected with two contacts 15 to transfer mechanical forces. The rods 14 are thus adapted to transfer mechanical forces from the contacts 15 to the electrical contacts in the contact module when the contact and operating elements are interconnected. The rods 14 extend out of the housing 11 through opening 40.

The face 12 is additionally formed with corresponding connecting elements in the form of two openings 13, which are adapted to cooperate with the hooks 3 shown in FIG. 1 to interconnect the contact module and the operating module.

The operating module and the contact element are preferably made of moulded plastics.

FIGS. 3 and 4 show a top view of the contact and operating modules shown in FIGS. 1 and 2 and also show the internal components. As mentioned above, the contact module comprises a housing 1 which is formed with a connecting part 2 in the form of a substantially laterally directed face. The face 2 is provided with two holes 4 through which mechanical connection with electrical contacts 27 arranged in the housing 1 may be obtained. The contact module is also formed with connecting elements 3 shown in FIG. 1.

The contact module moreover has an electrical connection 6 which may be connected with a control unit (not shown), said electrical connection 6 passing electrical signals by means of a wiring (not shown) to the control unit in dependence on the action exerted on the electrical contacts 27, which are mounted in the housing 1. The electrical contacts 27 are connected to an electrical connection 6 via wires 28.

FIG. 4 shows an operating module according to the invention. The operating module comprises a housing 11 which is formed with a connecting part 12 in the form of a substantially laterally directed face. The face 12 is provided with two through rods 14 which are mechanically connected with two contacts 15 to transfer mechanical forces. The rods 14 are thus adapted to transfer mechanical forces from the contacts 15 to the electrical contacts 27 in the contact module when the contact module and operating module are interconnected.

The operating module is moreover formed with corresponding connecting elements 13 shown in FIG. 2.

The individual operating modules may be constructed with different physical shapes so that the user will have the possibility of building precisely the physical structure of the complete foot operation that might be expedient.

FIG. 5, in a longitudinal section of the housing 11 of the operating module, shows an example of how a vertical mechanical movement of the contacts 15 is transferred to the mechanical rod 14. In the shown example, the operating module is formed with one mechanical contact 15.

A mechanical contact 15, which may be moved up and down by a mechanical action, has an inclined end face 15' arranged suitably with respect to a rod 14 having an inner end face 14' in housing 11.

The rod 14 is placed horizontally slidably in two holders 36 as well as a hole 39' in a connecting part 12, so that the inclined end face 14' can absorb forces from the inclined end face 15' when this is moved.

As the engagement faces 14', 15' are inclined, a horizontal movement of the rod 14 may thus be obtained.

The rod 14 is additionally provided with a stop device 37 which forms one engagement face for a spring 38 arranged around the rod 14, while the inner side of the connecting part 12 forms the other engagement face.

A mechanically downwardly directed action on the mechanical contact 15 thus causes the rod 14 to be displaced to the left. The spring 38 counteracts the movement and provides a return movement of rod 14 and contact 15 after terminated action on the mechanical contact 15.

The individual operating modules may be constructed in different physical shapes, so that the user will have the possibility of building precisely the physical structure of the complete foot operation that might be expedient.

Further, the operating modules may be constructed as adapters or extensions, so that the number of operating modules applied by the user may be varied or adapted, as needed.

FIG. 6 shows a section of another embodiment of an operating module with a mechanical connection in the form of an activating element 51, which is supported and guided by a guide rail 52 in such a manner that the activating element 51 may be displaced in the rail 52 to operate a contact 53 in a connected contact module (not shown).

The activating element 51 comprises an extension element 54 which is constructed as a leaf spring, and which is provided with a fixing part 56 at one end, so that the activating element 51 is fixed in the longitudinal direction of the rail 52 by means of a transverse groove and tongue connection. The activating element is provided with a pressure rod 55 on the opposite side of the extension element 54.

This pressure rod 55 may be moved forwards in the rail 52 as a consequence of a pressure action P on the activating element 51, the extension element 54 being pressed downwards against the bottom of the rail 52, which causes the extension element 54 to be stretched in that the end points of the extension element 54 are moved away from each other. As one end point is fixed to the rail 52 by the fixing part 56, the pressure action P will thus cause a linear displacement of the pressure rod 55 in the rail 52 in a direction toward the opening 70. When the pressure action P is removed again, the activating element 51 will return to its starting position. The extension element 54 is formed as a leaf spring in the preferred embodiment. However, its function may also be obtained by other shapes, such as a wave oz zigzag shape.

The pressure rod 55 is formed with a deformation element 57 which is resilient in the direction of movement of the pressure rod 55, at the end facing the opening 70 adjacent the contact 53. At the end of the deformation element 57, the activating element 51 is provided with an activating pin 58, which is constructed in such a manner that it may be moved through an opening 70 in the side of a connecting wall 60. The activating element 51 is provided with a spring 59 between the activating pin 58 and the end of the deformation element 57, which spring 59 yields upon the displacement of the pressure rod 55 in the rail 52 and is simultaneously tensioned so that the pin 58 jumps away from the contact 53 of the control module (not shown) upon cessation of the pressure action. The spring 59 also absorbs the inaccuracies that might occur, particularly in the contacts 53 used where the position of the push button and its spring load are not determined very accurately and where simple contacts which may be used in the present structure.

As appears more clearly from FIGS. 7 and 8, the activating element 51 is formed as one member, constructed by a plastics moulding. The activating element 51, according to this preferred embodiment of the invention, can thus easily be constructed and then mounted and possibly exchanged in an operating panel 60. The pressure rod 55 may be formed with an inverted U-shaped cross-section so that it may slide around the guide rail 52.

FIG. 9 shows, an exploded view of an operating panel 60 for a foot pedal which is provided with an operating device according to the invention. The lower part 61 of the operating panel 60 is formed with guide rails 52 and associated lateral openings (not shown) in a side plate 71 of the panel to receive one or more activating elements 51. The guide rails 52 may be formed integrally in the lower part 61, as is the case here.

In the construction of the activating element 51 according to the preferred embodiment of the invention, it is realized by the invention that the activating element 51 may advantageously be constructed such that it may be used for operating several contacts 53 in connection with the same operating panel 60. The activating element 51 may be formed with two or more pressure rods 55 and associated extension elements 54 which are connected with a common fixing means 72, as shown in dotted line in FIG. 9.

The operating panel 61 is provided with an upper part 64 in connection with which a plurality of pedals 65 are arranged for cooperation with the extension elements 54 in the activating element 51 in the operating device.

The flat structure of an operating device according to the invention moreover makes the device suitable for wall plugs.

It is realized by the invention that, as an alternative to the embodiment of the invention illustrated and described above, the fixing means 72 may be formed as laterally protruding pins which cooperate with a hole or a slot in the side of the guide rails. When each end of the extension element 54 is simultaneously provided with a pressure rod 55, the stretching of the extension element 54 may be used for simultaneous activation of two contacts 53. It should be mentioned in this connection that the contacts 53 may serve to control electrical as well as pneumatic or hydraulic systems.

What is claimed is:

1. A contact device for use in a foot switch, comprising:

a contact module having a housing (1) in which is arranged at least one electrical contact (27), and said housing (1) being designed with at least one connecting part (2) with one or more connecting elements (3), and said at least one electrical contact (27) may be achieved mechanically in said at least one connecting part (2), and an operating module having a housing (11) designed with at least one corresponding connecting part (12) with corresponding connecting elements (13) for attaching the operating module to the contact module, said operating module comprising at least one operating contact (15) which in association with at least one mechanical connection (14) can transfer a force on the at least one operating contact (15) to the connecting part (2) for operating the at least one electrical contact (27) of the contact module.

2. A contact device according to claim 1, wherein:

the contact module comprises an external electrical connection (6), said external connection is connected electrically to the electrical contacts (27) internally in the housing (1).

3. A contact device according to claim 1, wherein:

the connecting part (2) comprises a plurality of holes (4) or depressions arranged in the housing (1), each of said holes (4) or depression being provided with an associated one of the electrical contacts (27) which is activated mechanically through said hole (4) or depression.

4. A contract device according to claim 1, wherein:

the operating module comprises a housing (11) with at least one corresponding connecting face (12) corresponding connecting elements (13), the operating module comprises said at least one operating contact (15) which transfers a force from the at least one operating contact to the connecting face (12) via the at least one mechanical connection (14), wherein said at least one operating contact (15) is mechanically connected with said connecting face (12).

5. A contact device according to claim 4, wherein:

the at least one mechanical connection comprises a mechanical rod 14 extending completely or partly through the housing (11) and terminating in the vicinity of an opening (40) formed in the housing (11), said rod (14) being movably connected with said at least one operating contact (15), said at least one operating contact (15) being substantially perpendicularly to the rod (14).

6. A contact device according to claim 5, wherein:

the mechanical rod (14) has a resiliently compressible part and extends through said opening 40 formed in the housing (11).

7. A contact device according to claim 4, comprising:

a guide rail (52) within which is located an activating element (51), the activating element (51) having a pressure element (55) and an extension element (54), is arranged with fixing means (56) to fix the activating element (51) with respect to the guide rail (52), and the pressure element (55) is slidable within the guide rail (52) and activates at least one contact (53) due to pressure action on the extension element (54) against the guide rail (52).

8. A contact device according to claim 7, wherein:

the extension element (54) comprises a spring device with ends displaced from each other along the guide rail (52) by the pressure action against the guide rail (52).

9. A contact device according to claim 8, wherein:

the activating element (51) is constructed as one member.

10. A contact device according to claim 9, wherein:

the extension element (54) is positioned between the fixing means (56) and the pressure element (55).

11. An operating module according to claim 10, wherein:

the pressure element (55) is provided with an elastically resilient deformation zone (57) and an activating pin (58) at the end facing the contact (53), said activating pin having a spring collar (59).

12. A contact device according to claim 11, wherein:

the activating element (51) comprises at least two pressure elements (55) and associated extension elements (54) which are connected together with a common fixing means (72).

13. A contact device for use in a foot switch, comprising:

a contact module having a contact module housing (1) having at least one electrical contact (27) and at least one connecting face part (2), said at least one connecting face part (2) having at least one hook element (3), and said at least one electrical contact (27) mechanically in communication with said at least one connecting face part (2), and an operating module having an operating module housing (11) with at least one corresponding connecting wall part (12) with corresponding openings (13) for attaching the operating module to the contact module, said operating module comprising at least one operating contact (15) in communication with at least one mechanical connection (14) wherein said operating module can transfer a force on the at least one operating contact (15) to the at least one mechanical connection (14) thereby operating the at least one electrical contact (27) of the contact module, and wherein the contact module housing and the operating module housing are both sealed in such a manner as to be dust free and moisture resistant.

* * * * *